US008590080B1

(12) United States Patent
Staresinic

(10) Patent No.: US 8,590,080 B1
(45) Date of Patent: Nov. 26, 2013

(54) ARM REST BED ATTACHMENT ASSEMBLY

(71) Applicant: Larry M. Staresinic, Niagara Falls (CA)

(72) Inventor: Larry M. Staresinic, Niagara Falls (CA)

( * ) Notice: Subject to any disclaimer, the term of this patent is extended or adjusted under 35 U.S.C. 154(b) by 0 days.

(21) Appl. No.: 13/691,979

(22) Filed: Dec. 3, 2012

(51) Int. Cl.

| | |
|---|---|
| ***A47C 31/00*** | (2006.01) |
| ***A47C 21/08*** | (2006.01) |
| ***A47B 7/00*** | (2006.01) |
| ***A47C 17/86*** | (2006.01) |
| ***A47F 5/00*** | (2006.01) |
| ***E04G 3/00*** | (2006.01) |

(52) U.S. Cl.
USPC ..... 5/658; 5/429; 5/430; 5/623; 5/646; 5/662; 248/282.12; 248/125.9

(58) Field of Classification Search
USPC ..... 5/424–430, 623, 646, 658, 662; 248/292.12, 121, 122.1, 125.1, 125.3, 248/125.9
See application file for complete search history.

(56) References Cited

U.S. PATENT DOCUMENTS

| | | | | |
|---|---|---|---|---|
| 518,894 | A | 4/1894 | Petterson | |
| 561,341 | A | 6/1896 | Richard | |
| 2,609,261 | A | 9/1952 | Parker | |
| 2,766,463 | A * | 10/1956 | Bendersky | 5/623 |
| 2,981,959 | A * | 5/1961 | Burnham | 5/503.1 |
| 4,045,011 | A | 8/1977 | Ford | |
| 4,917,343 | A * | 4/1990 | Wainscott | 248/447.2 |
| 5,104,103 | A * | 4/1992 | Auchinleck et al. | 269/74 |
| 5,315,726 | A * | 5/1994 | Borenstein | 5/618 |
| 5,384,927 | A * | 1/1995 | Mardero et al. | 5/662 |
| 5,586,352 | A * | 12/1996 | O'Brien et al. | 5/662 |
| 6,012,182 | A * | 1/2000 | Allen et al. | 5/81.1 R |
| 6,039,293 | A * | 3/2000 | Minet | 248/125.8 |
| 6,101,650 | A | 8/2000 | Omdal et al. | |
| 6,102,344 | A * | 8/2000 | Kasvin et al. | 248/118 |
| 6,195,820 | B1 | 3/2001 | Heimbrock et al. | |
| 6,708,935 | B2 * | 3/2004 | Smeed | 248/118 |
| 7,093,313 | B2 * | 8/2006 | DeBraal et al. | 5/622 |
| 7,322,060 | B2 * | 1/2008 | Kirn | 5/623 |
| 7,472,445 | B2 * | 1/2009 | Miller | 5/662 |
| 7,624,737 | B2 * | 12/2009 | Klemm | 128/848 |
| 7,823,843 | B2 * | 11/2010 | Oberlaender et al. | 248/118 |
| 7,908,686 | B2 * | 3/2011 | Clapper et al. | 5/93.1 |
| 8,028,702 | B2 * | 10/2011 | DaSilva | 128/845 |
| 2005/0121578 | A1 * | 6/2005 | Asamarai et al. | 248/284.1 |
| 2007/0151032 | A1 * | 7/2007 | Heavrin | 5/662 |
| 2007/0186348 | A1 * | 8/2007 | Banks | 5/662 |
| 2009/0172884 | A1 | 7/2009 | Semlitsch | |
| 2011/0126353 | A1 | 6/2011 | Veenendaal | |

* cited by examiner

*Primary Examiner* — William Kelleher
*Assistant Examiner* — Eric Kurilla

(57) ABSTRACT

An arm rest bed attachment assembly supports an arm of a person while in bed. The assembly includes a support post and a cushion coupled to the support post. The cushion is configured for supporting an arm of a person while in bed. A support bracket is selectively insertable under a mattress on a bed. The support bracket is coupled to and extends from the support post.

9 Claims, 5 Drawing Sheets

ARM REST BED ATTACHMENT ASSEMBLY

BACKGROUND OF THE DISCLOSURE

Field of the Disclosure

The disclosure relates to arm rest devices and more particularly pertains to a new arm rest device for comfortably supporting a person's arm while the person is in bed.

SUMMARY OF THE DISCLOSURE

An embodiment of the disclosure meets the needs presented above by generally comprising a support post and a cushion coupled to said support post. The cushion is configured for supporting an arm of a person while in bed. A support bracket is selectively insertable under a mattress on a bed. The support bracket is coupled to and extends from the support post.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
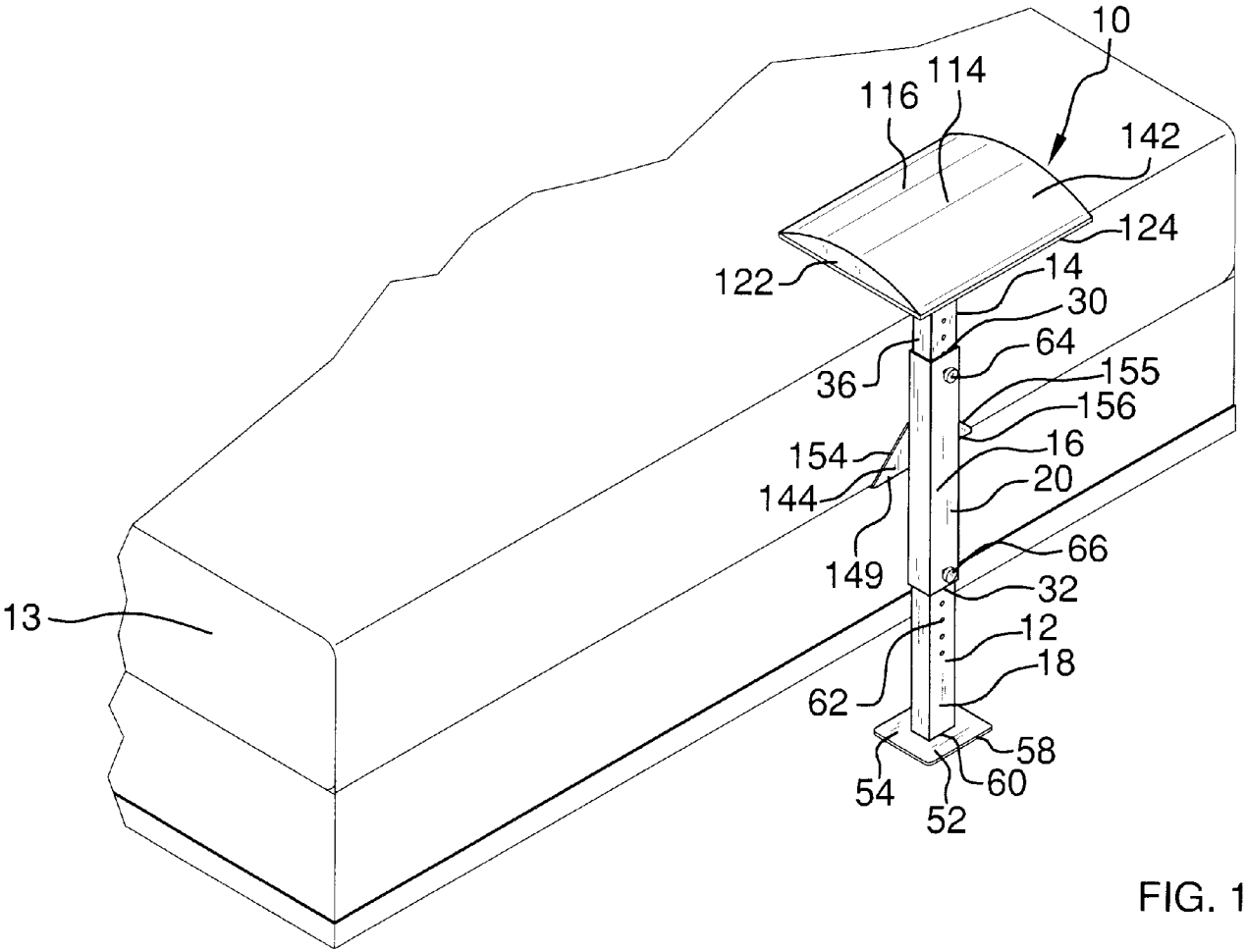
FIG. 1 is a top front side perspective view of an arm rest bed attachment assembly according to an embodiment of the disclosure.
Figure 2:
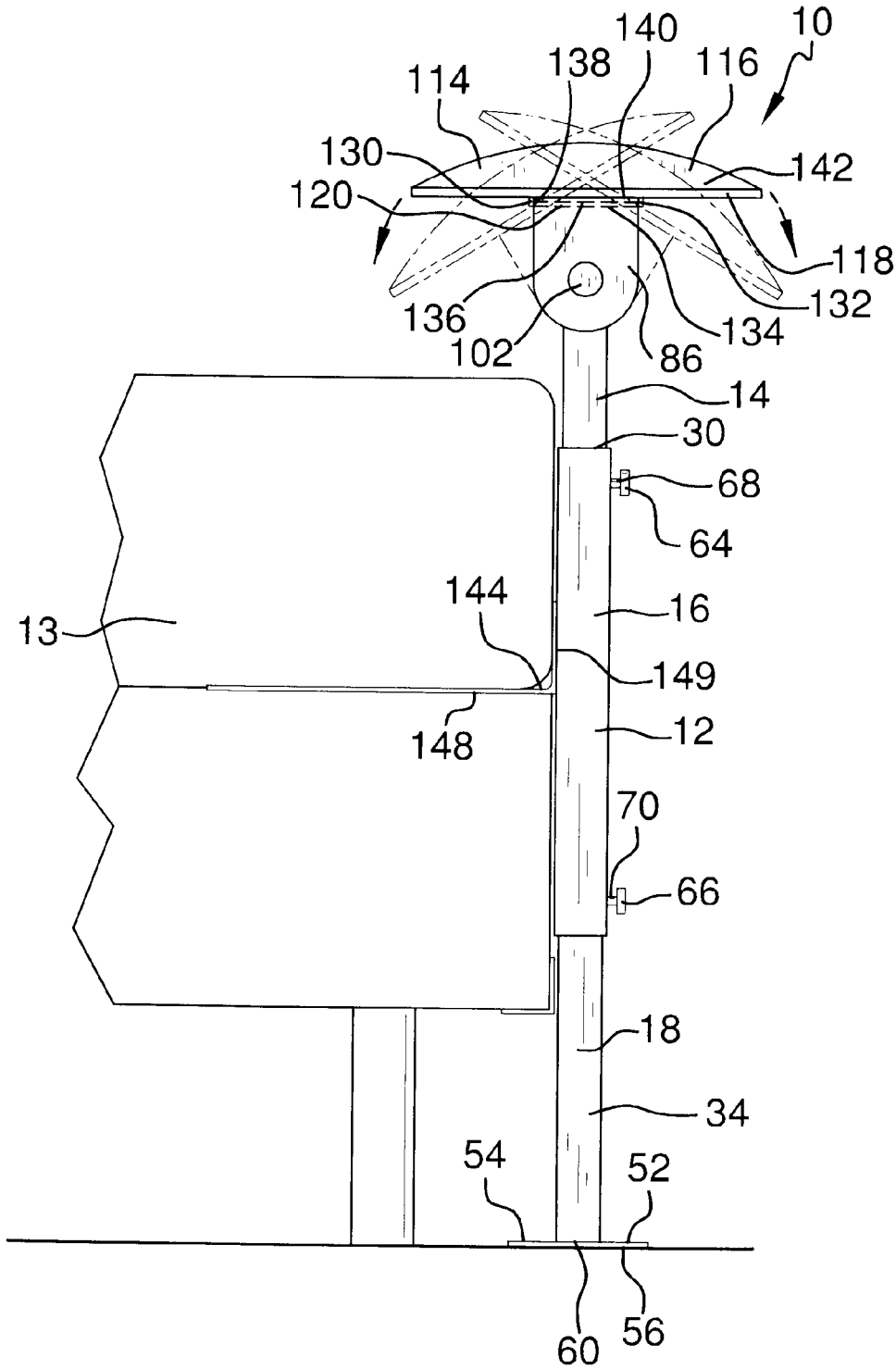
FIG. 2 is a side view of an embodiment of the disclosure in use.
Figure 3:
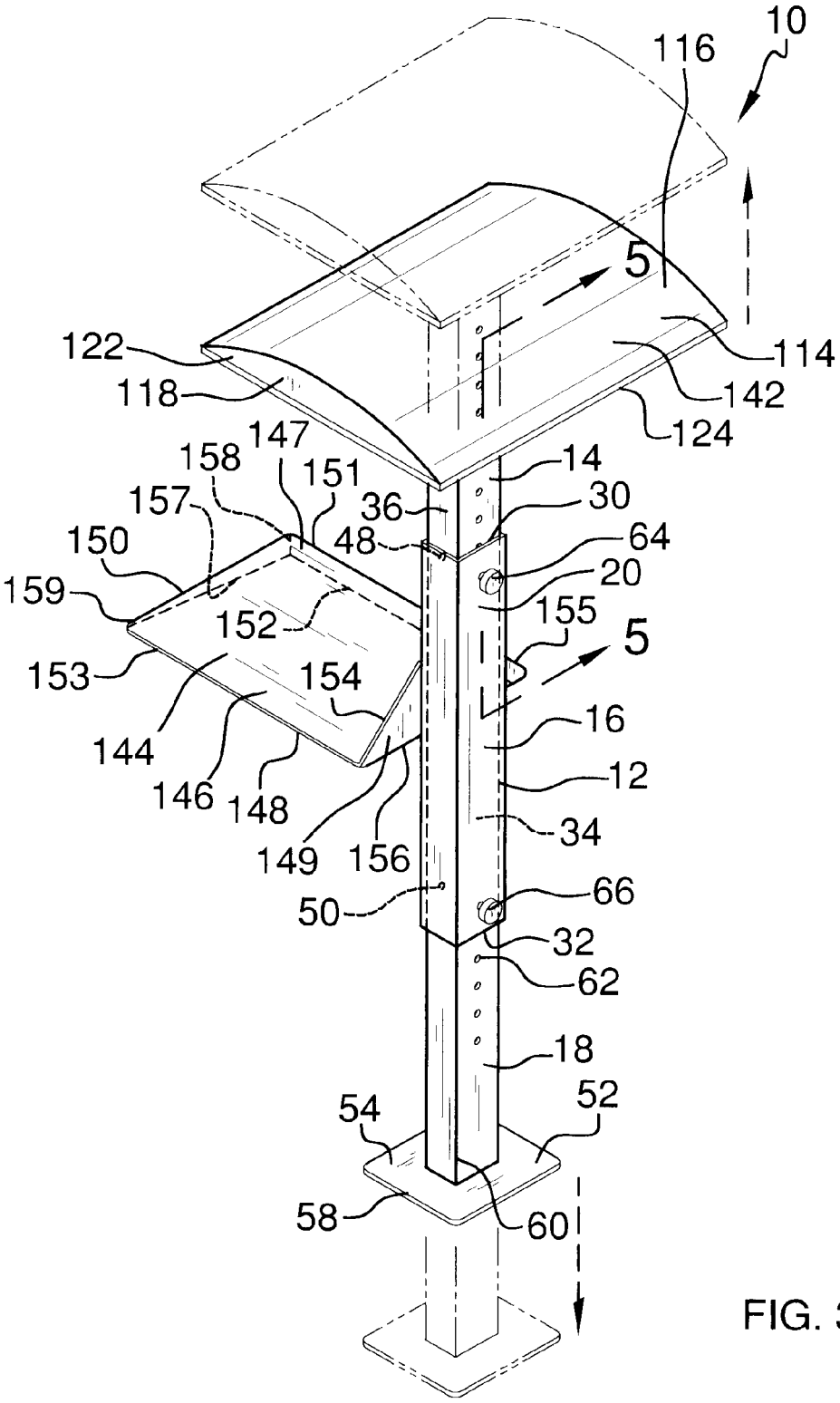
FIG. 3 is a top front side perspective view of an embodiment of the disclosure in use.
Figure 4:
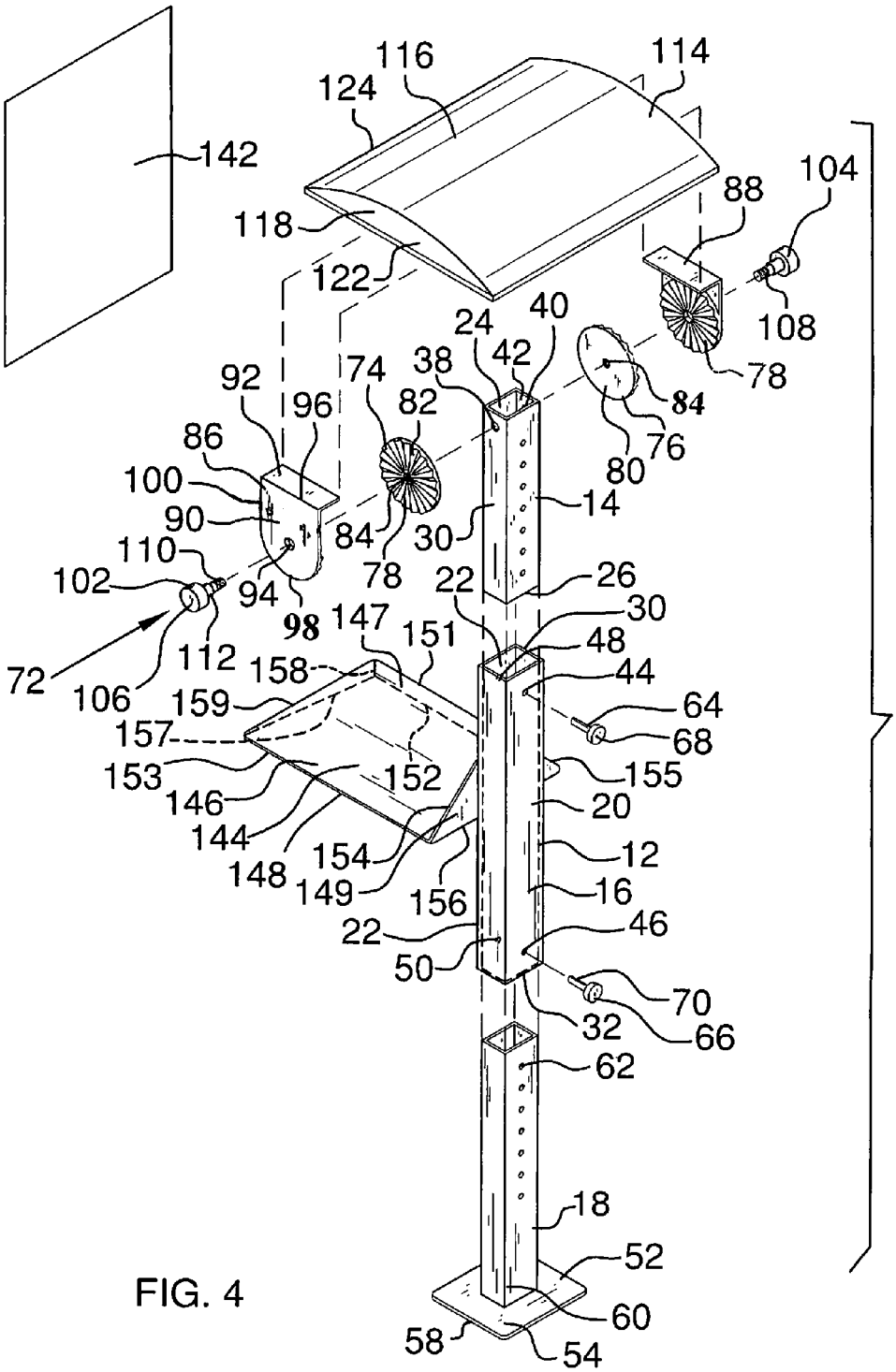
FIG. 4 is a partially-exploded top front side perspective view of an embodiment of the disclosure.
Figure 5:
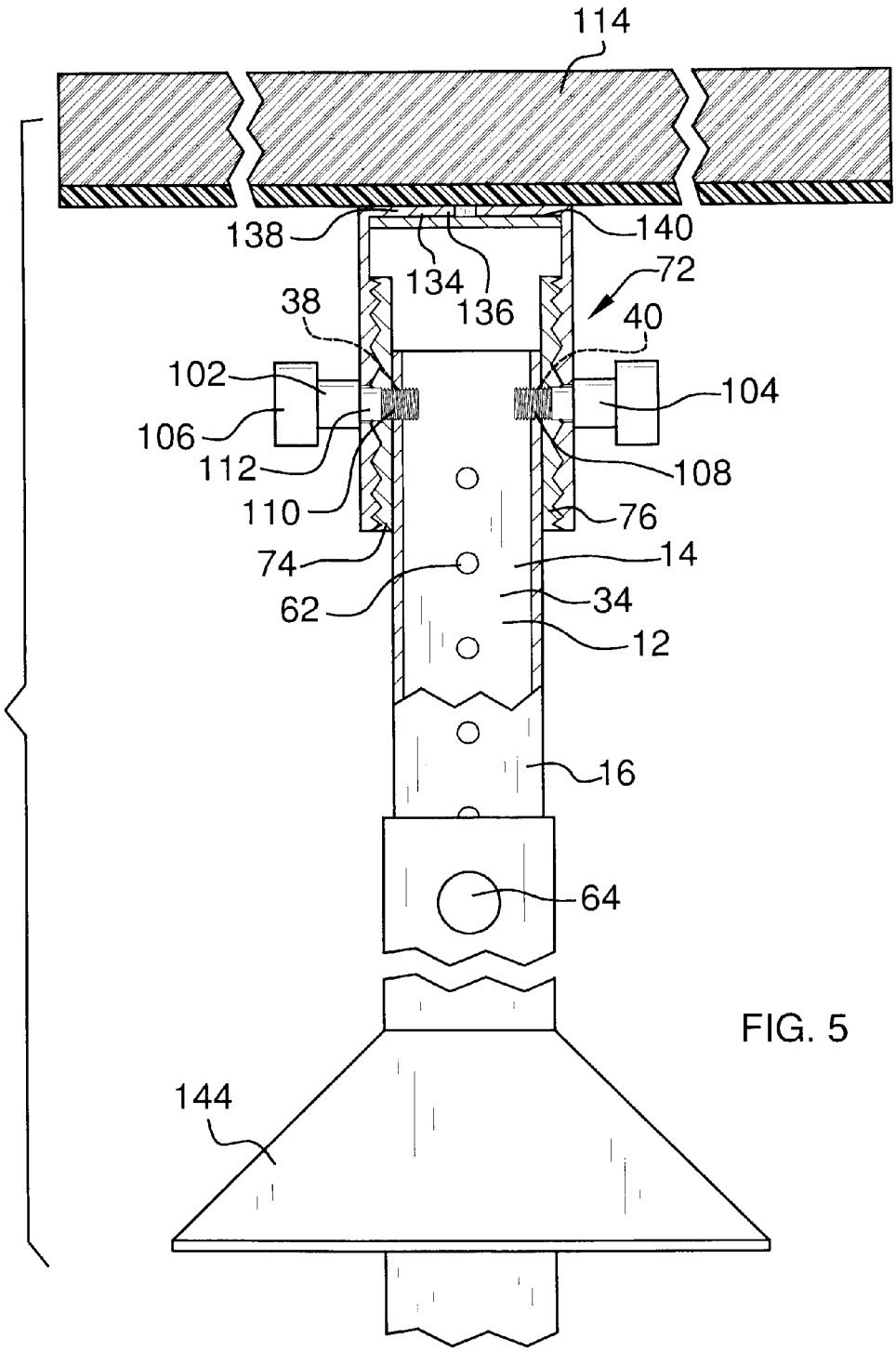
FIG. 5 is a cross-sectional view of an embodiment of the disclosure taken along line 5-5 of FIG. 3.

With reference now to the drawings, and in particular to FIGS. 1 through 5 thereof, a new arm rest device embodying the principles and concepts of an embodiment of the disclosure and generally designated by the reference numeral 10 will be described.

As best illustrated in FIGS. 1 through 5, the arm rest bed attachment assembly 10 generally comprises a support post 12 having an upper telescoping member 14, a middle telescoping member 16, and a lower telescoping member 18. Each of the telescoping members 14, 16, 18 has a front side 20 positioned opposite a back side 22, a top side 24 positioned opposite a bottom side 26, and a pair of lateral sides 28 extending between the front side 20 and the back side 22. The top side 24 and the bottom side 26 are open. The top side 24 has a top peripheral edge 30. The bottom side 26 has a bottom peripheral edge 32 positioned opposite the top peripheral edge 30. Each of the telescoping members 14, 16, 18 has a hollow interior 34 wherein the bottom side 26 of the upper telescoping member 14 is telescopically received within the top side 24 of the middle telescoping member 16 and the top side 24 of the lower telescoping member 18 is telescopically received within the bottom side 26 of the middle telescoping member 16. A first lateral side 36 of the upper telescoping member 18 has a first lateral aperture 38 positioned proximate the top peripheral edge 30 of the upper telescoping member 14. The first lateral aperture 38 is positioned opposite a second lateral aperture 40. The second lateral aperture 40 is positioned on a second lateral side 42 of the upper telescoping member 14. The front side 20 of the middle telescoping member 16 has a first front aperture 44 positioned proximate the top peripheral edge 30. The front side 20 of the middle telescoping member 16 has a second front aperture 46 positioned proximate the bottom peripheral edge 32. The back side 22 of the middle telescoping member 16 has a first back aperture 48 positioned opposite the first front aperture 44. The back side 22 of the middle telescoping member 16 has a second back aperture 50 positioned opposite the second front aperture 46. The assembly 10 is preferably comprised of plastic or metal material. The height of the support post 12 may be between approximately between 60 centimeters and 70 centimeters.

A base 52 has a top portion 54, a bottom portion 56, and a peripheral portion 58. The peripheral portion 58 extends between the top portion 54 and the bottom portion 56. The bottom peripheral edge 32 of the lower telescoping member 18 is coupled to a center 60 of the top portion 54 of the base 52.

A plurality of longitudinal apertures 62 are spaced and substantially aligned along the longitudinal direction of the front and back sides 20, 22 of the upper and lower telescoping members 14, 18 wherein each of the longitudinal apertures 62 on the front side 20 of the upper telescoping member 14 has a corresponding longitudinal aperture 62 on the back side 22 of the upper telescoping member 14. Similarly, each of the longitudinal apertures 62 on the front side 20 of the lower telescoping member 18 has a corresponding longitudinal aperture 62 on the back side 22 of the lower telescoping member 18.

A first connector 64 and a second connector 66 is provided. Each of the connectors 64, 66 has a head 68 and a shaft 70. The head 68 of the connectors 64, 66 has a width greater than a width of the first and second front apertures 44, 46 and the first and second back apertures 48, 50. The head 68 of the connectors 64, 66 is positioned on the front side 20 of the middle telescoping member 16 over the first front aperture 44 and over the second front aperture 46. The shaft 70 of the connectors 64, 66 has a width less than or equal to the first and second front apertures 44, 46 and the first and second back apertures 48, 50. The shaft 70 of the first connector 64 extends through the first front aperture 44 of the middle telescoping member 16 and is selectively positioned within one of the longitudinal apertures 62 when one of the longitudinal apertures 62 is aligned with the first front aperture 44 and the upper telescoping member 14 is telescopically received within the middle telescoping member 16. The first connector 64 further extends through one of the longitudinal apertures 62 positioned on the back side 22 of the upper telescoping member 14 wherein the longitudinal aperture 62 is aligned with the first back aperture 48 of the middle telescoping member 16. The shaft 70 of the second connector 66 extends through the second front aperture 46 of the middle telescoping member 16 and is selectively positioned within one of the longitudinal apertures 62 when one of the longitudinal apertures 62 is aligned with the second front aperture 46 and the lower telescoping member 18 is telescopically received within the middle telescoping member 16. The second connector 66 further extends through one of the longitudinal apertures 62 positioned on the back side 22 of the lower telescoping member 18 wherein the longitudinal aperture 62 is aligned with the second back aperture 50 of the middle telescoping member 16.

A locking assembly 72 has a first locking plate 74, a second locking plate 76, a first locking bracket 86, a second locking bracket 88, a first tightening bolt 102, and a second tightening bolt 104. Each of the locking plates 74, 76 has a first face 78, a second face 80, and an outer peripheral edge 82 extending between the first face 78 and the second face 80. Each of the locking plates 74, 76 is rounded and has a central aperture 84. The first face 78 of the locking plates 74, 76 has a plurality of ridges. The second face 80 of the locking plates 74, 76 is smooth. Each of the locking brackets 86, 88 has a main portion 90 and a tab 92. The main portion 90 has a central aperture 94, a top edge 96, an arcuate bottom edge 98, and a pair of lateral sides 100 extending between the top and bottom edges 96, 98 of the locking brackets 86, 88. The tab 92 extends horizontally away from the top edge 96 of each of the locking brackets 86, 88. Each of the tightening bolts 102, 104 has a head 106 and a shaft 108. The head 106 of the tightening bolts 102, 104 has a width greater than a width of the first and second lateral apertures 38, 40. The shaft 108 of the tightening bolts 102, 104 has a threaded portion 110 and a non-threaded portion 112. The head 106 of the tightening bolts 102, 104 is positioned on the lateral side 28 of the upper telescoping member 14 proximate the first and second lateral apertures 38, 40. The shaft 108 of the tightening bolts 102, 104 has a width less than or equal to the first and second lateral apertures 38, 40.

The shaft 108 of the first tightening bolt 102 extends through the central aperture 84 of the first locking plate 74 and the first locking bracket 86 when the central aperture 84 of the first locking plate 74 is aligned with and coupled to the central aperture 84 of the first locking bracket 86 wherein the first face 78 of the first locking plate 74 is coupled to the main portion 90 of the first locking bracket 86. The shaft 108 of the first tightening bolt 102 further extends through the first lateral aperture 38 of the upper telescoping member 14 wherein the shaft 108 of the first tightening bolt 102 is selectively inserted into one of the longitudinal apertures 62 when one of the longitudinal apertures 62 is aligned with the first lateral aperture 38 and the upper telescoping member 14 is telescopically received within the middle telescoping member 16. The shaft 108 of said second tightening bolt 104 extends through the central aperture 94 of the second locking plate 76 and the second locking bracket 88 when the central aperture 94 of the second locking plate 76 is aligned with and coupled to the second locking bracket 88 wherein the first face 78 of the second locking plate 76 is coupled to the main portion 90 of the second locking bracket 88. The shaft 108 of the second tightening bolt 104 further extends through the second lateral aperture 40 of the upper telescoping member 14 wherein the shaft 108 of the second tightening bolt 104 is selectively inserted into one of the longitudinal apertures 62 when one of the longitudinal apertures 62 is aligned with the second lateral aperture 40 and the upper telescoping member 14 is telescopically received within the middle telescoping member 16. The first tightening bolt 102 is spaced from the second tightening bolt 104 when the tightening bolts 102, 104 are positioned in the support post 12.

A cushion 114 has a top portion 116, a bottom portion 118, a support member 120, a pair of lateral sides 122, and a pair of lateral edges 124. The lateral sides 122 and the lateral edges 124 extend between the top portion 116 and the bottom portion 118 of the cushion 114. The lateral sides 122 have a top edge 126 and a bottom edge 128. The bottom edge 128 of the cushion 114 is horizontal. The top edge 126 of the cushion 114 is curved upward and away from the bottom edge 128. The support member 120 has a first portion 130, a second portion 132, and a medial portion 134 extending between the first and second portions 130, 132. The first and second portions 130, 132 of the cushion 114 extend downward and away from the bottom portion 118 of the cushion 114. The medial portion 134 defines a slot 136 wherein the tab 92 of the first locking bracket 86 is received into a first side 138 of the slot 136 and the tab 92 of the second locking bracket 88 is received into a second side 140 of the slot 136. The cushion 114 is pivotally coupled to the locking brackets 86, 88 when the locking brackets 86, 88 are selectively inserted into the slot 136. A height of the cushion 114 is adjustable when the first and second connectors 64, 66 are selectively extended through a selected one of the longitudinal apertures 62. The cushion 114 is configured to support an arm of a person while in bed and may be used while the person is using an IV or to prevent injuries to the arm due to sleeping disorders. The cushion 114 may have memory foam support. A cover 142 is open and removably positioned around the cushion 114. The cover 142 may be secured using drawstring, snaps, or hook and loop fasteners. The length of the cushion 114 may be between approximately 20 centimeters and 35 centimeters, and the width may be between approximately 15 centimeters and 30 centimeters.

A support bracket 144 has a first face 146, a second face 147, a third face 148, a first triangular base 149, and a second triangular base 150. The support bracket 144 has a shape of a triangular prism wherein a juncture between the first and second faces 146, 147 of the support bracket 144 defines a first edge 151. A juncture between the second and third faces 147, 148 of the support bracket 144 defines a second edge 152. A juncture between the third and first faces 148, 146 defines a third edge 153. A juncture between the first face 146 of the support bracket 144 and the first triangular base 149 defines a fourth edge 154. A juncture between the second face 147 of the support bracket 144 and the first triangular base 149 defines a fifth edge 155. A juncture between the third face 148 and the first triangular base 149 defines a sixth edge 156. A juncture between the first face 146 of the support bracket 144 and the second triangular base 150 defines a seventh edge 157. A juncture between the second face 147 of the support bracket 144 and the second triangular base 150 defines an eighth edge 158. A juncture between the third face 148 and the second triangular base 150 defines a ninth edge 159. The first face 146 of the support bracket 144 extends downward and away from the first edge 151 at an acute angle. The second face 147 of the support bracket 144 extends downward and away from the first edge 151 at the same acute angle. The third face 148 extends horizontally and is coupled to the first and second faces 146, 147. The first triangular base 149 is coupled to the back side 22 of the middle telescoping member 16. The support bracket 144 is selectively insertable under a mattress 13 on a bed. The first edge 151 of the support bracket 144 is positioned against the mattress 13 wherein the assembly 10 is configured to support the arm of a person while in bed. The support bracket 144 is thin enough to slide between a mattress 13 and a box spring. The length of the support bracket 144 may be between approximately 15 centimeters and 35 centimeters, and the width may be between approximately 10 centimeters and 25 centimeters.

In use, as stated above and shown in the Figures, the support bracket 144 is inserted under a mattress 13 on a bed. The cushion 114 is configured to support the arm of a person while in bed when the cushion is coupled to the support post 12 and the upper and lower telescoping members 14, 18 are telescopically received within the middle telescoping member 16. The support post 12 can be adjusted to a desired height by aligning different longitudinal apertures 62 with the first and second front apertures 64, 66 and inserting the first and second connectors 64, 66 therethrough. The cushion 114 pivots about the support post 12 wherein the angle of the cushion is adjustable. The cover 142 of the cushion 114 may be removed and washed between uses. The support bracket may be removed from below the mattress 13 and stored while the assembly 10 is not in use.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. An arm rest bed attachment assembly comprising:

a support post;

a cushion being coupled to said support post, said cushion being configured for supporting an arm of a person while in bed;

a support bracket being selectively insertable under a mattress on a bed, said support bracket being coupled to and extending from said support post; and a locking assembly selectively coupling said support post and said cushion, said locking assembly including a first locking plate and a second locking plate, each of said first and second locking plates having a first face opposite a second face, each of said second faces of said first and second locking plates being coupled to said support post, said first face of said first and second locking plates having a plurality of ridges, said second face of said first and second locking plates being smooth, said locking assembly having a first and second tightening bolt, said first tightening bolt extending through a central aperture of said first locking plate and further extending through a first locking bracket when said first locking plate is aligned with and coupled to a central aperture of said first locking bracket wherein said first face of said first locking plate is coupled to said first locking bracket, said first tightening bolt further extending through a first lateral aperture of said support post, said second tightening bolt extending through a central aperture of said second locking plate and a second locking bracket when said central aperture of said second locking plate is aligned with and coupled to said second locking bracket wherein said first face of said second locking plate is coupled to said second locking bracket, said second tightening bolt further extending through a second lateral aperture of support post; and said cushion having a top portion, a bottom portion, a support member, a pair of lateral sides, and a pair of lateral edges, said lateral sides and said lateral edges extending between said top portion and said bottom portion of said cushion, said lateral sides having a top edge and a bottom edge, said bottom edge of said cushion being horizontal, said support member having a first portion, a second portion, and a medial portion extending between said first and second portions, said first and second portions of said cushion extending downward and away from said bottom portion of said cushion, said medial portion defining a slot wherein a tab of said first locking bracket is received into a first side of said slot and said tab of said second locking bracket is received into a second side of said slot, said slot having a bottom edge configured to support an associated one of said tabs, said first side and said second side of said slot being open.

2. The assembly of claim 1, further comprising a cover removably positioned around said cushion.

3. The assembly of claim 1, further comprising a base being coupled to said support post.

4. The assembly of claim 1, further comprising said cushion being pivotally coupled to said support post.

5. The assembly of claim 1, further comprising said support post being telescopic wherein said support post can be adjusted to a desired height.

6. The assembly of claim 5, further comprising said support post having an upper telescoping member, a middle telescoping member, and a lower telescoping member, each of said telescoping members having a front side positioned opposite a back side, a top side positioned opposite a bottom side, and a pair of lateral sides extending between said front side and said back side, said top side and said bottom side being open, said top side having a top peripheral edge, said bottom side having a bottom peripheral edge positioned opposite said top peripheral edge, each of said telescoping members having a hollow interior wherein said bottom side of said upper telescoping member is telescopically received within said top side of said middle telescoping member and said top side of said lower telescoping member is telescopically received within said bottom side of said middle telescoping member, said upper telescoping member having a plurality of longitudinal apertures positioned on said front side and said back side of said upper telescoping member, said lower telescoping member having a plurality of longitudinal apertures positioned on said front side and said back side of said lower telescoping member, said middle telescoping member having a first front aperture and a first back aperture, said first front aperture being positioned proximate said top peripheral edge of said front side of said middle telescoping member, said first back aperture being positioned opposite said first front aperture on said back side of said middle telescoping member, said middle telescoping member having a second front aperture and a second back aperture, said second front aperture being positioned proximate said top peripheral edge of said back side of said middle telescoping member, said second back aperture being positioned opposite said second front aperture on said back side of said middle telescoping member.

7. The assembly of claim 6, further comprising a first connector and a second connector, said first connector being positioned over said first front aperture of said middle telescoping member, said second connector being positioned over a second front aperture of said middle telescoping member, said first connector extending through said first front aperture and selectively positioned within one of a plurality of longitudinal apertures of said upper telescoping member when one of said longitudinal apertures is aligned with said first front aperture and said upper telescoping member is telescopically received within said middle telescoping member, said first connector further extending through one of said longitudinal apertures positioned on said back side of said upper telescoping member wherein said longitudinal aperture on said back side of said upper telescoping member is aligned with a first back aperture of said middle telescoping member, said second connector extending through said second front aperture and selectively positioned within one of said longitudinal apertures when one of said longitudinal apertures is aligned with said second front aperture and said lower telescoping member is telescopically received within said middle telescoping member, said second connector further extending through one of said longitudinal apertures positioned on said back side of said lower telescoping member wherein said longitudinal aperture on said back side of said lower telescoping member is aligned with a second back aperture of said middle telescoping member.

8. The assembly of claim 7, further comprising said support bracket being coupled to said back side of said middle telescoping member.

9. An arm rest bed attachment assembly comprising:

a support post having an upper telescoping member, a middle telescoping member, and a lower telescoping member, each of said telescoping members having a front side positioned opposite a back side, a top side positioned opposite a bottom side, and a pair of lateral sides extending between said front side and said back side, said top side and said bottom side being open, said top side having a top peripheral edge, said bottom side having a bottom peripheral edge positioned opposite said top peripheral edge, each of said telescoping members having a hollow interior wherein said bottom side of said upper telescoping member is telescopically received within said top side of said middle telescoping member and said top side of said lower telescoping member is telescopically received within said bottom side of said middle telescoping member, a first lateral side of said upper telescoping member having a first lateral aperture positioned proximate said top peripheral edge of said upper telescoping member, said first lateral aperture being positioned opposite a second lateral aperture, said second lateral aperture being positioned on a second lateral side of said upper telescoping member, said front side of said middle telescoping member having a first front aperture positioned proximate said top peripheral edge, said front side of said middle telescoping member having a second front aperture positioned proximate said bottom peripheral edge, said back side of said middle telescoping member having a first back aperture positioned opposite said first front aperture, said back side of said middle telescoping member having a second back aperture positioned opposite said second front aperture;

a square base having a top portion, a bottom portion, and a peripheral portion, said peripheral portion extending between said top portion and said bottom portion, said bottom peripheral edge of said lower telescoping member being coupled to a center of said top portion of said square base;

a plurality of longitudinal apertures being spaced and substantially aligned along the longitudinal direction of said front and back sides of said upper and lower telescoping members wherein each of said longitudinal apertures on said front side of said upper telescoping member has a corresponding longitudinal aperture on said back side of said upper telescoping member and each of said longitudinal apertures on said front side of said lower telescoping member has a corresponding longitudinal aperture on said back side of said lower telescoping member;

a first connector and a second connector, each of said connectors having a head and a shaft, said head having a width greater than a width of said first and second front apertures and said first and second back apertures, said head being positioned on said front side of said middle telescoping member over said first front aperture and over said second front aperture, said shaft having a width less than or equal to said first and second front apertures and first and second back apertures, said shaft of said first connector extending through said first front aperture of said middle telescoping member and selectively positioned within one of said longitudinal apertures when one of said longitudinal apertures is aligned with said first front aperture and said upper telescoping member is telescopically received within said middle telescoping member, said first connector further extending through one of said longitudinal apertures positioned on said back side of said upper telescoping member wherein said longitudinal aperture is aligned with said first back aperture of said middle telescoping member, said shaft of said second connector extending through said second front aperture of said middle telescoping member and selectively positioned within one of said longitudinal apertures when one of said longitudinal apertures is aligned with said second front aperture and said lower telescoping member is telescopically received within said middle telescoping member, said second connector further extending through one of said longitudinal apertures positioned on said back side of said lower telescoping member wherein said longitudinal aperture is aligned with said second back aperture of said middle telescoping member;

a locking assembly, wherein said locking assembly comprises a first locking plate and a second locking plate, each of said locking plates having a first face, a second face, and an outer peripheral edge extending between said first face and said second face, each of said locking plates being rounded and having a central aperture, said first face of said locking plates having a plurality of ridges, said second face of said locking plate being smooth, a first locking bracket and a second locking bracket, each of said locking brackets having a main portion and a tab, said main portion having a central aperture, a top edge, an arcuate bottom edge, and a pair of lateral sides extending between said top and bottom edges of said locking brackets, said tab extending horizontally away from said top edge of said locking bracket, and a first tightening bolt and a second tightening bolt, each of said tightening bolts having a head and a shaft, said head having a width greater than a width of said first and second lateral apertures, said shaft having a threaded portion and a non-threaded portion, said head being positioned on said lateral side of said upper telescoping member proximate said first and second lateral apertures, said shaft having a width less than or equal to said first and second lateral apertures, said shaft of said first tightening bolt extending through said central apertures of said first locking plate and said first locking bracket when said central aperture of said first locking plate is aligned with and coupled to said central aperture of said first locking bracket wherein said first face of said first locking plate is coupled to said main portion of said first locking bracket, said shaft of said first tightening bolt further extending through said first lateral aperture of said upper telescoping member wherein said shaft of said first tightening bolt is selectively inserted into one of said longitudinal apertures when one of said longitudinal apertures is aligned with said first lateral aperture and said upper telescoping member is telescopically received within said middle telescoping member, said shaft of said second tightening bolt extending through said central apertures of said second locking plate and said second locking bracket when said central aperture of said second locking plate is aligned with and coupled to said second locking bracket wherein said first face of said second locking plate is coupled to said main portion of said second locking bracket, said shaft of said second tightening bracket further extending through said second lateral aperture of said upper telescoping member wherein said shaft of said second tightening bolt is selectively inserted into one of said longitudinal apertures when one of said longitudinal apertures is aligned with said second lateral aperture and said upper telescoping member is telescopically received within said middle telescoping member, said first tightening bolt being spaced from said second tightening bolt when said tightening bolts are positioned in said support post;

a cushion having a top portion, a bottom portion, a support member, a pair of lateral sides, and a pair of lateral edges, said lateral sides and said lateral edges extending between said top portion and said bottom portion of said cushion, said lateral sides having a top edge and a bottom edge, said bottom edge of said cushion being horizontal, said top edge of said cushion being curved upward and away from said bottom edge, said support member having a first portion, a second portion, and a medial portion extending between said first and second portion, said first and second portions of said cushion extending downward and away from said bottom portion of said cushion, said medial portion defining a slot wherein said tab of said first locking bracket is received into a first side of said slot and said tab of said second locking bracket is received into a second side of said slot, said cushion being pivotally coupled to said locking brackets when said locking brackets are selectively inserted into said slot, a height of said cushion being adjustable when said first and second connectors are selectively extended through a selected one of said longitudinal apertures, said cushion being configured for providing a comfortable resting position for a person's arm while in bed;

a cover removably positioned around said cushion; and a support bracket having a first face, a second face, a third face, a first triangular base, and a second triangular base, said support bracket having a shape of a triangular prism wherein a juncture between said first face and said second face defines a first edge, a juncture between said second face and said third face defines a second edge, a juncture between said third face and said first face defines a third edge, a juncture between said first face and said first triangular base defines a fourth edge, a juncture between said second face and said first triangular base defines a fifth edge, a juncture between said third face and said first triangular base defines a sixth edge, a juncture between said first face and said second triangular base defines a seventh edge, a juncture between said second face and said second triangular base defines an eighth edge, a juncture between said third face and said second triangular base defines a ninth edge, said first face extending downward and away from said first edge at an acute angle, said second face extending downward and away from said first edge at said acute angle, said third face extending horizontally and coupled to said first face and said second face, said first triangular base being coupled to said back side of said middle telescoping portion, said support bracket being selectively insertable under a mattress on a bed, said first edge of said support bracket being positioned against the mattress wherein said assembly can be used to comfortably support a person's arm while the person is in bed.

* * * * *